US005755014A

United States Patent [19]

Yamaguchi et al.

[11] Patent Number: 5,755,014

[45] Date of Patent: May 26, 1998

[54] SEPARABLE BOTTOM STOP ASSEMBLY FOR SLIDE FASTENER

[75] Inventors: Yoshiharu Yamaguchi; Toyosaku Ogura, both of Toyama-ken, Japan

[73] Assignee: YKK Corporation, Tokyo, Japan

[21] Appl. No.: 882,036

[22] Filed: Jun. 25, 1997

[30] Foreign Application Priority Data

Jun. 28, 1996 [JP] Japan ..... 8-168876

[51] Int. Cl.[6] ..... A44B 19/00

[52] U.S. Cl. ..... 24/433; 24/388; 24/434; 24/432

[58] Field of Search ..... 24/433, 434, 435, 24/432, 388

[56] References Cited

U.S. PATENT DOCUMENTS 2,588,648 3/1952 Moehler ..... 24/433
3,618,178 11/1971 Hansen ..... 24/388
4,742,603 5/1988 Kasai ..... 24/433
4,976,016 12/1990 Takabatake ..... 24/433
5,388,312 2/1995 Fudaki ..... 24/433

*Primary Examiner*—Victor N. Sakran
*Attorney, Agent, or Firm*—Hill & Simpson

[57] ABSTRACT

A separable bottom stop assembly of thermoplastic resin comprising a box molded on a lower end of one of opposite slide fastener stringers and an insert pin molded on a lower end of the other fastener stringer. The box has a straight insert-pin receiving hole off to one side. An outer wall of the insert-pin hole has a side slit having at its lower end a stopper. The insert pin is taper toward its lower end and has a straight tape-side edge. A guide ridge is integrally formed with the insert pin with a thin portion between them. When the insert pin is inserted into the insert-pin hole of the box, a lower end of the guide ridge slides along edges of the side slit, guiding insertion of the insert pin to facilitate smooth insertion without exerting load on the insert pin.

10 Claims, 5 Drawing Sheets

SEPARABLE BOTTOM STOP ASSEMBLY FOR SLIDE FASTENER

BACKGROUND OF THE INVENTION

1. Field of the Invention

This invention relates to a separable bottom stop assembly, for a slide fastener, which comprises a box, a box pin and an insert pin molded of thermoplastic resin on lower ends of opposite fastener stringers.

2. Description of the Related Art

Various types of conventional separable bottom stop assemblies, for slide fasteners, which are molded of thermoplastic resin are currently known. For example, as shown in FIG. 7 of the accompanying drawings, Japanese Utility Model Publication No. Sho 54-31050 discloses a conventional-type separable bottom stop assembly, for a slide fastener, in which a first reinforcement wing 131, a box pin 102 and a first guide pin 130 are molded of thermoplastic resin on a lower end portion of one of opposite fastener stringers, while a second reinforcement wing 132, an insert pin 103 and a second guide pin 110 are molded of thermoplastic resin on a lower end portion of the other fastener stringer. The first guide pin 130 extends substantially parallel to the box pin 102 so as to define between them a first guide groove 105, and the second guide pin 110 extends substantially parallel to the insert pin 103 so as to define between them a second guide groove 111. And a box 101, which has a box-pin-receiving hole off to one side and an insert-pin-receiving hole 106 off to the other side and is molded independently of the box pin 102 and the insert pin 103, is attached to the box pin 102 as the box pin 102 is fitted into the box-pin-receiving hole.

Further, as shown in FIG. 8, Japanese Utility Model Publication No. Sho 59-25225 discloses another conventional-type separable bottom stop assembly, for a slide fastener, in which a box 1', a box pin 2', a first thin fin 5' outwardly of the box pin 2' and a first auxiliary ridge 4' are molded of thermoplastic resin on a first reinforcement tape 18' of thermoplastic resin film adhered to a lower end portion of one fastener stringer 15', while likewise an insert pin 3', a second thin fin 11' outwardly of the insert pin 3' and a second auxiliary ridge 10' are molded of thermoplastic resin on a second reinforcement tape 18" of thermoplastic resin film adhered to a lower end portion of the other fastener stringer 15'. The first and second auxiliary ridges 4', 10' extend parallel to the box pin 2' and the insert pin 3', respectively, and the first and second fins 5', 11' extend between the first auxiliary ridge 4' and the box pin 2' and between the second auxiliary ridge 10' and the insert pin 3', respectively.

However, according to the first-named known separable bottom stop assembly of FIG. 7, the insert pin 103 and the second guide pin 110 which is longer than the insert pin 103 as well as the reinforcement wing 132 are integrally molded of thermoplastic resin on the fastener stringer at one end, and the insert pin 103 and the second guide pin 110 are arcuate in order to conform to the configuration of the flange 121 of a slider 120 so that the flange 121 of the slider 120 and a vertical side wall of the box 101 are to be inserted in the second narrow guide groove. During insertion, since the insert pin 103 is positively guided, smooth insertion of the insert pin 103 into the box 101 cannot be realized. Further, since the second guide pin 110 and the second reinforcement wing 132 extend upwardly beyond the top end of the insert pin 103, the fastener tape around the lowermost coupling element touching the insert pin 103 is not flexible so that the lowermost coupling element is pressed firmly against the central guide post of the slider, thus causing great wear of the coupling head and resulting in an insufficient durability for use for a long time. Also, partly since the insert pin 103 is curved and partly since the box pin 102 is separate from the box 101, manufacturing of such separable bottom stop assembly would be very meticulous.

According to the second-named separable bottom stop assembly of FIG. 8, partly since the second fin 11' between the insert pin 3' and the second auxiliary ridge 10' has a large width and partly since the insert pin 3' is positively guided during insertion, the insert pin tends to wear. Also, because of the large width of the second fin 11', the insert pin 3' tends to pivotally move during insertion so that a smooth inserting operation of the insert pin 3' is difficult to achieve. Further, since the second fin 11' and the second auxiliary ridge 10' are aligned with the level of the top end of the insert pin 3', the fastener tape about the lowermost coupling element touching the insert pin 3' is not flexible, causing a stress on the lowermost coupling element during insertion. Furthermore, since the lower end portion of the insert pin is curved, molding of the insert pin 3' and the box 1' would be meticulous.

SUMMARY OF THE INVENTION

With the foregoing problems in view, it is a first object of this invention to provide a separable bottom stop assembly of thermoplastic resin, for a slide fastener, in which an insert pin can be inserted into and removed from a box nimbly and smoothly, with no burden in operation and less wear, as the insert pin serves as an auxiliary guide and a guide ridge disposed outwardly thereof guide positively.

A second object of the invention is to provide a separable bottom stop assembly, for a slide fastener, in which an insert pin can be inserted into a slider and a box in a stable form as the slider is held with no lateral movement, thus facilitating inserting and removing of the insert pin.

A third object of the invention is to provide a small-size separable bottom stop assembly, for a slide fastener, which can secure adequate softness in a fastener tape about an upper end of an insert pin, namely, about the lowermost coupling element and in which the insert pin can be inserted into and removed from the box with reduced burden on the lowermost coupling element and with adequate resistance for a long period of use.

A fourth object of the invention is to provide a separable bottom stop assembly, for a slide fastener, in which either of a box and an insert pin has such a shape that it is easy to mold of thermoplastic resin, thus improving the productivity.

A fifth object of the invention is to provide a separable bottom stop assembly, for a slide fastener, in which an insert pin can be smoothly guided when it is inserted into a box, thus stabilizing an inserted posture of the insert pin and hence making the separable bottom stop assembly neat in appearance.

A sixth object of the invention is to provide a separable bottom stop assembly, for a slide fastener, in which means for guiding an insert pin when it is inserted into a box is disposed on opposite sides or only one side of a fastener tape, either of which arrangement may be selected according to the kind of use.

According to a first aspect of the invention, a separable bottom stop assembly for a slide fastener, comprises: a box pin of thermoplastic resin adapted to be molded on a lower end of one of opposite fastener stringers of the slide fastener; a box of thermoplastic resin fixed to the box pin and having an insert-pin receiving hole; an insert pin of thermoplastic resin adapted to be molded on a lower end of the other fastener stringer for being inserted into the insert-pin receiving hole of the box; and a guide ridge of thermoplastic resin integrally formed with a tape-side edge of the insert pin via a thin portion. The box has a side slit in an outer wall of the insert-pin receiving hole, the outer wall having at its lower end a stopper. The guide ridge has a lower end slidable along edges of the side slit.

According to a second aspect of the invention, the separable bottom stop assembly further includes a guide projection integrally formed with the box and upwardly extending parallel to the box pin so as to define with the box pin a slider-holding recess having a width substantially equal to the thickness of flanges of a slider of the slide fastener.

According to a third aspect of the invention, in the separable bottom stop assembly, the guide ridge disposed parallel to the insert pin has a top portion extending upwardly and terminating short of the level of an upper end of the insert pin.

According to a fourth aspect of the invention, the separable bottom stop assembly further includes a reinforcement of thermoplastic resin adapted to be attached to a lower end of a fastener tape associated with the other fastener stringer at a range upper end of which is substantially aligned with the level of a top portion of the guide ridge.

According to a fifth aspect of the invention, in the separable bottom stop assembly, the insert-pin receiving hole of the box is straight, and the insert pin is taper toward its lower end and has a straight tape-side edge.

According to a sixth aspect of the invention, in the separable bottom stop assembly, the thin portion between the guide insert pin and the guide ridge has a varying width decreasing toward its upper end and increasing toward its lower end, and each thin portion has at its lower end a contact recess engageable with the stopper.

According to a seventh aspect of the invention, in the separable bottom stop assembly, the guide ridge and the thin portion are disposed on only one side of a fastener tape.

Alternatively, according to an eighth aspect of the invention, in the separable bottom stop assembly, either of the guide ridge and the guide groove are a double form disposed one on each side of the fastener tape.

According to a ninth aspect of the invention, in the separable bottom stop assembly, the guide projection and the slider-holding recess are disposed on only one side of the fastener tape.

Alternatively, according to a tenth aspect of the invention, in the separable bottom stop assembly, the guide projection and the slider-holding recess are a double form disposed one on each side of a fastener tape.

DETAILED DESCRIPTION OF THE PREFERRED EMBODIMENTS

Preferred embodiments of a separable bottom stop assembly according to this invention will now be described in detail with reference to the accompanying drawings.

Figure 1:
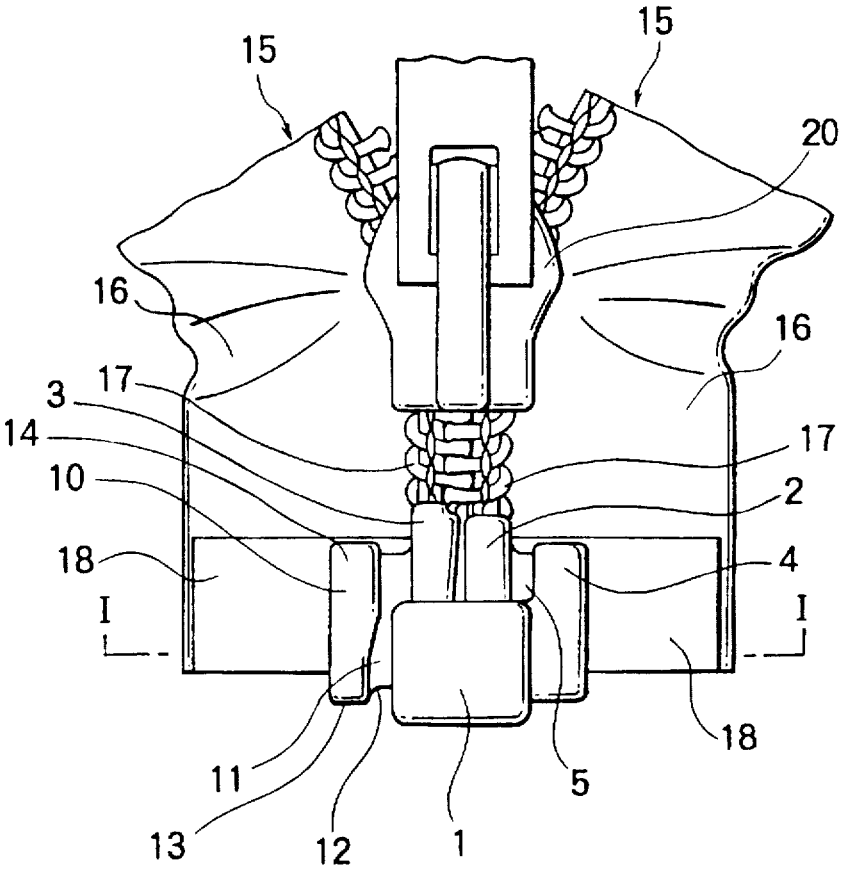
FIG. 1 is a fragmentary plan view of a slide fastener in which a separable bottom stop assembly according to a first embodiment of this invention is used.

As shown in FIG. 1, the separable bottom stop assembly generally comprises three members, i.e., a box 1, a box pin 2 and an insert pin 3. The first two members, the box 1 and the box pin 2, are molded of thermoplastic resin such as polyamide, polyacetal, polypropylene or polybutyleneterephtalate, in a unitary form on a lower end of one fastener stringer 15, and likewise the third member, the insert pin 3 to be inserted into the box 1, is integrally molded of thermoplastic resin on a lower end portion of the other fastener stringer 15.

For molding the box 1 or the insert pin 3 on the lower end portion of each fastener stringer 15, a thermoplastic resin film or a thermoplastic resin film laminate is adhered to a lower end portion of a fastener tape 16 to form a reinforcement 18, or thermoplastic resin liquid is permeated and solidified through a lower end portion of a fastener tape 16 to form a reinforcement 18, thus reinforcing the lower end portion of the fastener tape 16. Then, a box or an insert pin 3 is molded on opposite surfaces of the reinforcement 18 along the fastener-element-attaching marginal portion in the reinforcement 18 by injection or extrusion molding using thermoplastic resin.

The box pin 2 extends along the extension of a row of fastener element 17 attached to the fastener tape 16 beyond the upper edge of the reinforcement 18, and the box 1 is integrally formed with a lower end of the box pin 2. A guide projection 4 is integrally formed with one side of the box 1, extending upwardly in an L-shape parallel to the box pin 2 and terminating in an upper end substantially aligned with the upper edge of the reinforcement 18 so as to define with the box pin 2 a pair of shallow slider-holding recesses 5 one on each side of the stringer 15. The slider-holding recesses 5 have a common width corresponding to the thickness of a flange 21 in a slider 20 so that the slider 20 can be held in a stable posture during insertion. The box 1 has off to the other side a straight insert-pin-receiving hole 6 into which the insert pin 3 is to be inserted. An outer wall 7 of the insert-pin receiving hole 6 has a side slit 8 extending downwardly and terminating in a stopper 9 for receiving an lower end of a thin portion 11 which is disposed parallel to the insert pin 3.

Figure 2:
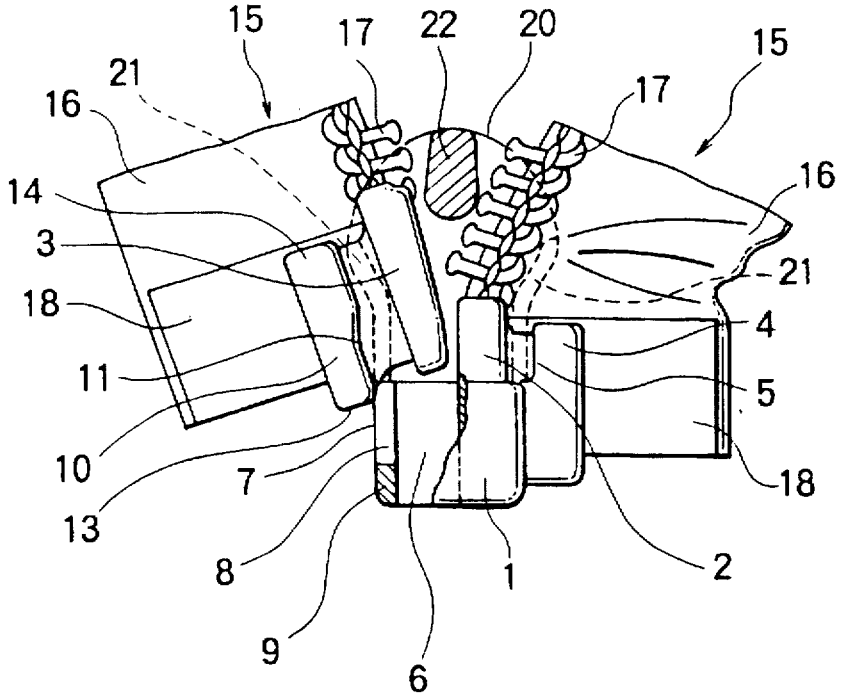
FIG. 2 shows an initial stage of insertion of an insert pin of the separable bottom stop assembly.
Figure 3:
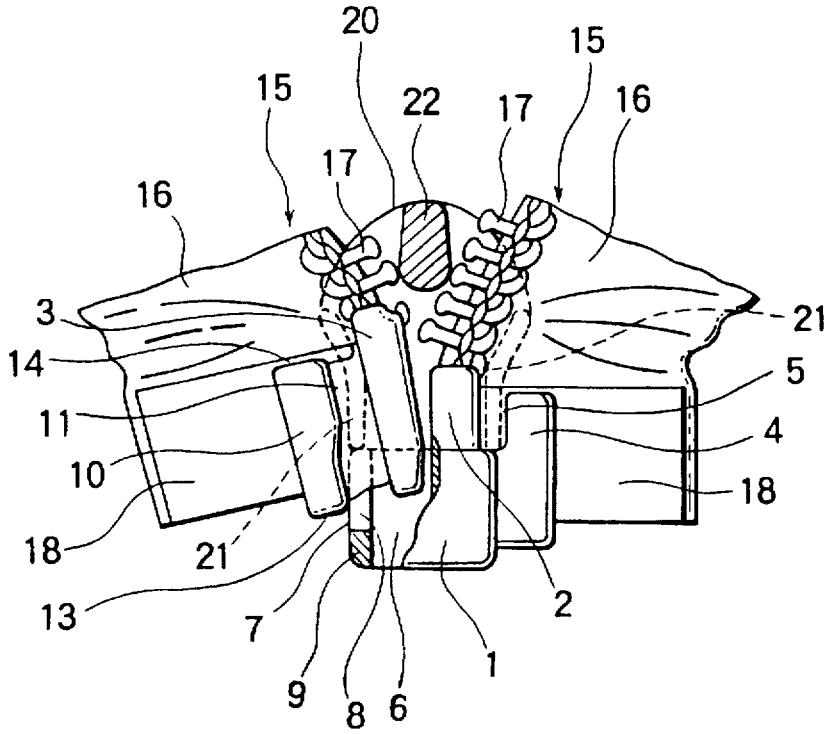
FIG. 3 shows an intermediate stage of insertion of the insert pin of the separable bottom stop assembly.
Figure 4:
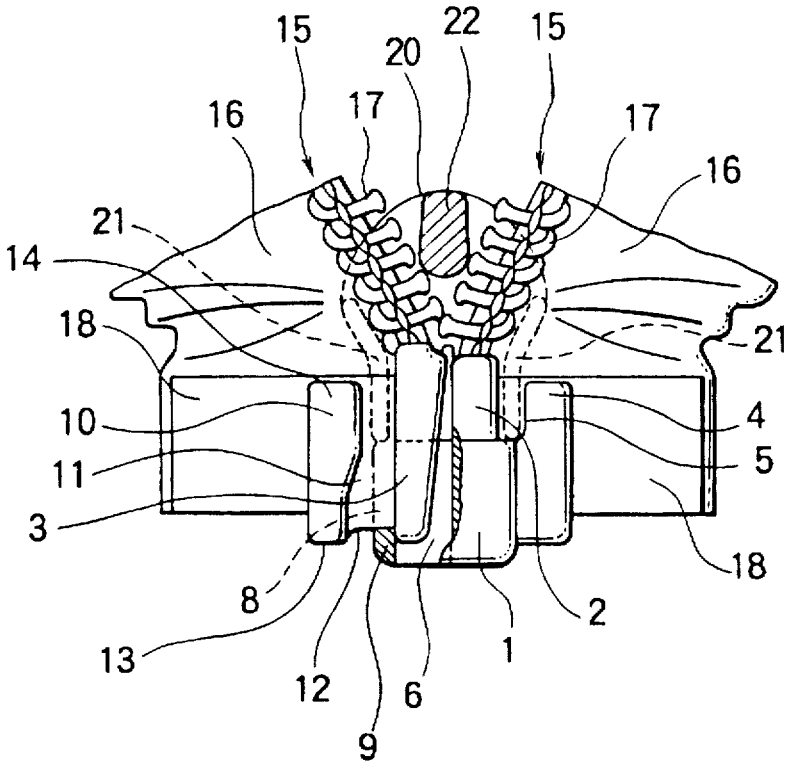
FIG. 4 shows a final stage of insertion of the insert pin of the separable bottom stop assembly.

On the other hand, the insert pin 3 extends along the extension of a row of coupling element 17, which is attached to the other fastener tape 16, beyond the upper edge of the reinforcement 18 and is taper toward its lower end, having a straight tape-side edge. A guide ridge 10 is integrally formed with an outer side of the insert pin 3 in parallel so as to define with the insert pin 3 a thin portion 11 extending upwardly and terminating in a top portion 14 substantially aligned with the upper edge of the reinforcement 18. Therefore, when the thin portion 11 is threaded through the upper and lower flanges 21 of the slider 20 and the side slit 8 of the box 1 as shown in FIGS. 2–4, the inner side of a lower end 13 of the guide ridge 10 slides on the outer edges of the side slit 8, facilitating insertion of the insert pin 3. With the thin portion 11, a guide groove is defined between the insert pin 3 and the guide ridge 10.

Each thin portion 11 between the insert pin 3 and the guide ridge 10 has a varying width decreasing toward its upper end near the upper end 14 of the guide ridge 10 and increasing toward its lower end near the lower end 13 of the guide ridge 10, so as to facilitate insertion of the flange 21 of the slider 20, and to easily contact the edge of the side slit 8 of the box 1. And the thin portion 11 is formed to be a contact recess 12 engageable with the stopper 9, making the lower side of the separable bottom stop assembly neat in appearance.

Figure 5:
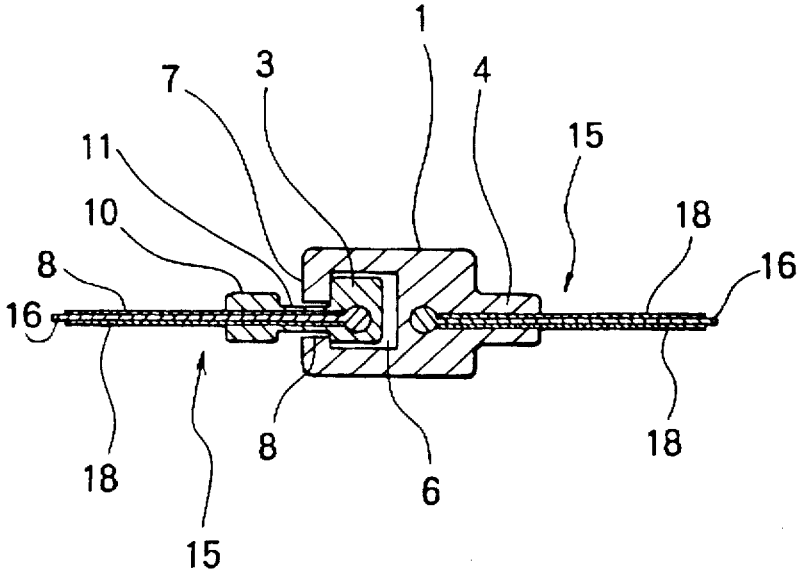
FIG. 5 is a transverse cross-sectional view taken along line I—I of FIG. 1.
Figure 6:
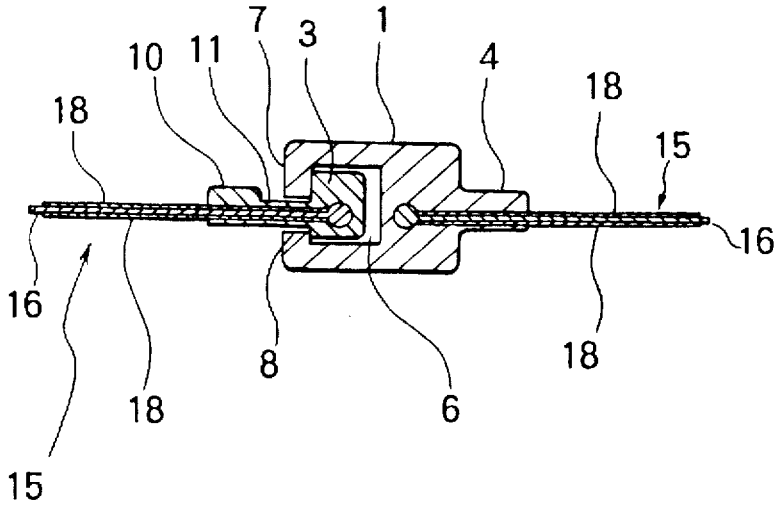
FIG. 6 is a transverse cross-sectional view similar to FIG. 5, but showing a modified separable bottom stop assembly according to a second embodiment.
Figure 7:
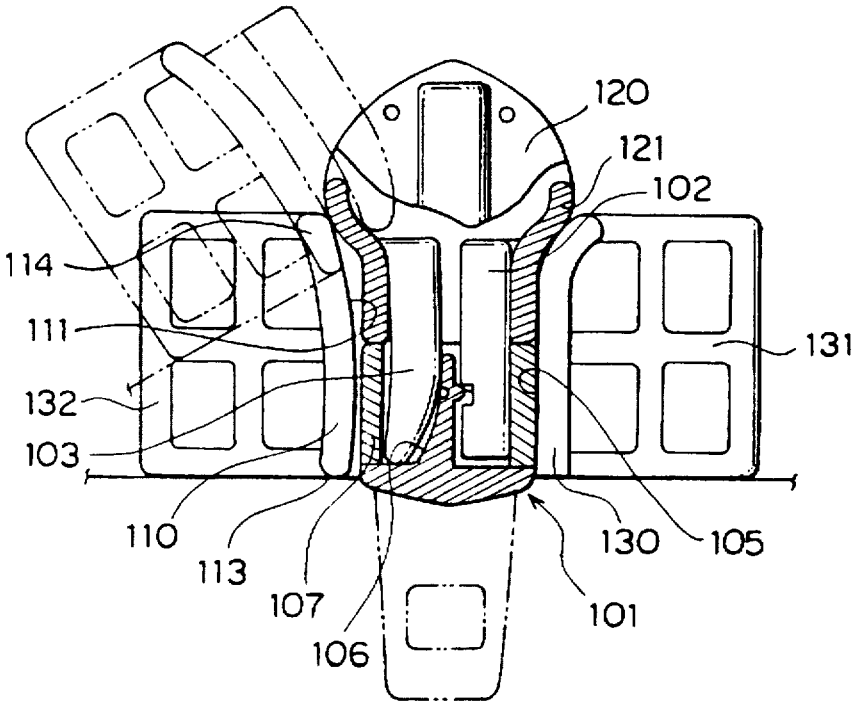
FIG. 7 (PRIOR ART)
FIG. 7 is a front view, with parts broken away, of a convention separable bottom stop assembly for a slide fastener.
Figure 8:
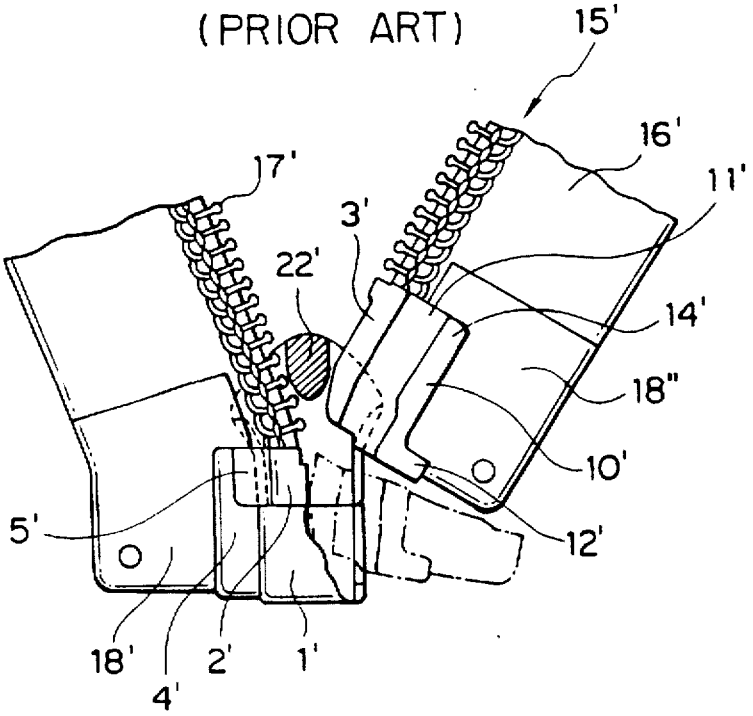
FIG. 8 (PRIOR ART)
FIG. 8 is a front view, with parts broken away, of another conventional separable bottom stop assembly for a slide fastener.

In the foregoing embodiment, the box 1 and the box pin 2 are molded in a unitary form. Alternatively, the box pin 2 may be solely molded on the lower end portion of one fastener stringer 15, and the box 1 may be molded independently and may be fixed to the lower end of the box pin 2. Further, in the foregoing embodiment, each of the guide projection 4 and the guide ridge 10 is a double form disposed one of each side of the fastener tape 16 as shown in FIG. 5; alternatively, each of the guide projection 4 and the guide ridge 10 may be a single form disposed on only one side of the fastener tape 16 as shown in FIG. 6, leaving the other side flat. In FIGS. 2–4, reference number 22 designates a central guide post of the slider 20.

The separable bottom stop assembly of this invention as thus constructed has the following advantageous results:

In this invention, in the separable bottom stop assembly molded of thermoplastic resin, the guide ridge 10 is integrally molded at a tape-side edge of the insert pin 3 via the thin portion 11, and the side slit 8 with the stopper 9 being formed at the lower end of the outer wall 7 of the insert-pin-receiving hole 6 of the box 1 is provided, and the inner side of the lower end 13 of the guide ridge 10 is formed to be guided along the edge of the side slit 8. As a result, at the time of inserting the insert pin 3 into the box 1, the guide ridge 10 contacts the edge of the side slit 8 to slide as being guided, so that the insertion can be done nimbly and smoothly. Furthermore, the insert pin 3 serves merely as an auxiliary, the insert pin 3 does not wear and can be durable for a long time use.

Partly since the slider-holding recess 5 is disposed between the box pin 2 projecting upwardly from the box 1 and the guide projection 4 extending upwardly and terminating short of the level of the upper end of the box pin 2 and has a width substantially equal to the thickness of the flange 21 of the slider 20, it is possible to insert the insert pin 3 into the slider 20 and the box 1 in a stable form with the slider 20 being held so as not to move laterally, thus facilitating inserting and removing of the insert pin 3.

Since the guide ridge 10 integrally formed with the insert pin 3 parallel extends upwardly and terminates short of the level of the top portion 14 of the insert pin 3, it is possible to reduce the entire size of the separable bottom stop assembly and to facilitate insertion of the insert pin 3 as well as to finish the product neatly in appearance.

Since the reinforcement 18 of thermoplastic resin arranged over the lower end portion of the fastener tape 16 has an upper edge substantially aligned with the level of the top portion 14 of the guide ridge 10, it is possible to facilitate molding of the guide ridge 10 and to secure adequate softness of the fastener tape 16 at an area near the lowermost coupling element as well as to prevent the fastener elements 17 from being pressed against the central guide post 22 of the slider 20, thus protecting the coupling elements 17 and making the separable bottom stop assembly durable for a long period of use.

Partly since the insert-pin receiving hole 6 of the box 1 is straight and partly since the insert pin 3 is taper toward its lower end 13 and has a straight tape-side edge, it is possible to mold the box 1 and the insert pin 3 much more simply as compared to the conventional product, in which both the box 1 and the insert pin 3 are arcuate in shape, thus improving the productivity.

Since the thin portion 11 between the insert pin 3 and the guide ridge 10 has a varying width decreasing toward its top portion 14 and increasing to its lower end 13 and terminates in the contact recess 12 to contact with the stopper 9, it is possible to guide the insert pin 3 reliably without rattling during insertion and to hold the insert pin 3 stably in an inserted posture.

When each of the guide ridge 10 and the thin portion 11 is a double form disposed one on each side of the fastener tape 16, it is possible to insert and remove the insert pin 3 into and from the box 1 smoothly and accurately and to make the separable bottom stop assembly adequately tough.

When the guide ridge 10 and the thin portion 11 are disposed on only one side of the fastener tape 16, it is possible to reduce the quantity of material so that a large-size separable bottom stop assembly can be manufactured with a minimum amount of material.

When the guide projection 4 and the slider-holding recess 5 are a double form disposed one on each side of the fastener tape 16, it is possible to hold the slider 20 reliably without rattling during insertion, thus facilitating insertion of the insert pin 3 and making the separable bottom stop assembly equately tough.

When the guide projection 4 and the slider-holding recess 5 are disposed on only one side of the fastener tape 16, it is possible to reduce the quantity of material so that a large-size separable bottom stop assembly can be manufactured with a minimum quantity of material.

What is claimed is:

1. A separable bottom stop assembly for a slide fastener, comprising:

(a) a box pin of thermoplastic resin adapted to be molded on a lower end of one of opposite fastener stringers of the slide fastener;

(b) a box of thermoplastic resin fixed to said box pin and having an insert-pin receiving hole and a side slit in an outer wall of said insert-pin receiving hole, said outer wall having at its lower end a stopper;

(c) an insert pin of thermoplastic resin adapted to be molded on a lower end of the other slide stringer for being inserted into said insert-pin receiving hole of said box; and (d) a guide ridge of thermoplastic resin integrally formed with a tape-side edge of said insert pin via a thin portion, said guide ridge having a lower end slidable along edges of said side slit.

2. A separable bottom stop assembly according to claim 1, further including a guide projection integrally formed with said box and upwardly extending parallel to said box pin so as to define with said box pin a slider-holding recess having a width substantially equal to the thickness of flanges of a slider of the slide fastener.

3. A separable bottom stop assembly according to claim 2, wherein said guide projection and said slider-holding recess are disposed on only one side of said fastener tape.

4. A separable bottom stop assembly according to claim 2, wherein said guide projection and said slider-holding recess are a double form disposed one on each side of said fastener tape.

5. A separable bottom stop assembly according to claim 1, wherein said guide ridge disposed parallel to the insert pin has a top portion extending upwardly and terminating short of the level of an upper end of said insert pin.

6. A separable bottom stop assembly according to claim 5, further including a reinforcement of thermoplastic resin adapted to be attached to a lower end of a fastener tape associated with the other fastener stringer at a range upper end of which is substantially aligned with the level of a top portion of said guide ridge.

7. A separable bottom stop assembly according to claim 1, wherein said insert-pin receiving hole of said box is straight, and said insert pin is taper toward its lower end and has a straight tape-side edge.

8. A separable bottom stop assembly according to claim 1, wherein said guide groove between said insert pin and said guide ridge has a varying width decreasing toward its upper end and increasing toward its lower end, and each said thin portion has at its lower end a contact recess engageable with said stopper.

9. A separable bottom stop assembly according to claim 1, wherein said guide ridge and said thin portion are disposed on only one side of a fastener tape.

10. A separable bottom stop assembly according to claim 1, wherein either of said guide ridge and said thin portion is a double form disposed one on each side of said fastener tape.

* * * * *